US005485677A

United States Patent [19]

Seber

[11] Patent Number: 5,485,677

[45] Date of Patent: Jan. 23, 1996

[54] KNIFE WITH FABRIC CUTTER

[75] Inventor: Brett P. Seber, Escondido, Calif.

[73] Assignee: Buck Knives, Inc., El Cajon, Calif.

[21] Appl. No.: 307,182

[22] Filed: Sep. 16, 1994

Related U.S. Application Data

[63] Continuation-in-part of Ser. No. 929,731, Aug. 13, 1992, Pat. No. 5,359,778.

[51] Int. Cl.[6] ..... B26B 29/00

[52] U.S. Cl. ..... 30/294; 30/142

[58] Field of Search ..... 30/161, 280, 289, 30/294, 314, 142, 124, 143; 7/118

[56] References Cited

U.S. PATENT DOCUMENTS

| | | | |
|---|---|---|---|
| 3,100,935 | 8/1963 | Leafe | 30/294 |
| 3,445,931 | 5/1969 | Knudson . | |
| 3,605,268 | 9/1971 | Cassell, Sr. . | |
| 3,670,733 | 6/1972 | Carlisle . | |
| 3,673,687 | 7/1972 | Phillips et al. . | |
| 4,134,206 | 1/1979 | Beermann | 30/294 |
| 4,805,303 | 2/1989 | Gibbs | 30/161 |
| 5,359,778 | 11/1994 | Seber et al. | 30/294 |

FOREIGN PATENT DOCUMENTS 1225073 9/1966 Germany .

OTHER PUBLICATIONS

Jack Safety Knife. Photocopy of physical article (2 pages).
Case Catalog, pp. 4 and 11.
Sporting Classics, p. 97 (Jan.–Feb. 1992).
Knives '91, pp. 124, 169, 174, and 194.
Advertisement for "Belly Zipper".
Advertisement for "Game Zipper".

*Primary Examiner*—Hwei-Siu Payer
*Attorney, Agent, or Firm*—Gregory Garmong

[57] ABSTRACT

A knife has a handle, a blade joined to the handle and having a blade back, and a fabric cutter integral with the blade. The fabric cutter includes a fabric cutter body extending laterally outwardly from the back side of the blade, with the outwardly extending margin of the fabric cutter body defining a fabric cutter back. A finger extends rearwardly at least about 0.2 inches toward the handle from the outward margin of the fabric cutter body. The finger and the blade back are substantially parallel to each other and separated by a distance of from about 0.100 to about 0.150 inches to form a fabric cutter slot having a cutting edge at its bottom.

20 Claims, 2 Drawing Sheets

KNIFE WITH FABRIC CUTTER

This application is a continuation-in-part of application Ser. No. 07/929,731, filed Aug. 13, 1992, now U.S. Pat. No. 5,359,778 for which priority is claimed.

BACKGROUND OF THE INVENTION

This invention relates to knives, and, more particularly, to a knife with a fabric cutting implement thereon.

A situation commonly encountered in emergency services work is the rescue of a person trapped in an automobile. The trapped person is constrained by a heavy fabric seat belt. Depending upon the orientation of the vehicle, all or part of the weight of the person may be supported by the seat belt. It may be impossible for the emergency services worker to release the person by operating the usual seat belt release, because the clothing of the trapped person may be wrapped around the release, because the weight of the trapped person suspended by the seat belt prevents the mechanical operation of the release, because of damage to the release, or because of damage to the vehicle that prevents the rescuer from reaching the release.

In such situations, the rescuer must cut the seat belt to free the trapped person, and sometimes must first cut away part of the clothing of the trapped person to reach the seat belt. The cutting must be accomplished quickly and without cutting the trapped person or the rescuer. In some instances, the cutting of the seat belt must be accomplished in the dark, in a very cramped space if the passenger compartment has been collapsed by damage to the vehicle, in the presence of smoke or fire, and sometimes under a combination of all of these adverse conditions.

At the present time, emergency services personnel use various techniques for cutting the seat belt when necessary. Shears can be used, but they are not easily operated in a cramped space and in any event do not readily cut the seat belt fabric. (Household scissors are simply not capable of cutting the heavy fabric.) The seat belt fabric can be cut with a very sharp knife placed between the trapped person and the belt, with the sharpened portion of the blade against the seat belt, and pulled outwardly. There is the danger that, under the adverse conditions of the rescue, the knife may be incorrectly oriented or that the trapped person or the rescuer may be cut. It may also be possible to use a Jack Safety Knife to cut seat belts. The Jack Safety Knife includes a two-part plastic frame that supports two razor blades at an angle to each other to form a cutting region. Such a knife has a large spacing at the opening to the cutting region so that the trapped person or rescuer may be cut during the use of the knife, involves multiple parts, and is not sufficiently robust for many situations.

There is a therefore a need for an implement including a fabric cutter that can be used by emergency services personnel to free trapped persons by cutting the seat belt and possibly clothing to first reach the seat belt. The present invention fulfills this need, and further provides related advantages.

SUMMARY OF THE INVENTION

The present invention provides a knife-type implement that includes a fabric cutter particularly adapted for cutting seat belt fabric, but which is also suitable for cutting the thinner fabric of clothing such as denim or cotton cloth. The fabric cutter is suitable for use in cramped conditions, as there are not moving parts to be operated. The fabric cutter and its supporting structure permit the cutting of the seat belt from either side. That is, the fabric cutter can be placed between the trapped person and the seat belt, or outside the seat belt, and in either position is highly effective in cutting the tensioned seat belt fabric. In either position, there is no risk of accidentally cutting either the trapped person or the rescuer.

In accordance with the invention, a knife comprises a handle, a blade joined to the handle and having a blade back, and a fabric cutter integral with the blade. The fabric cutter includes a fabric cutter body extending laterally outwardly from the blade back side of the knife blade, with the outwardly extending margin of the fabric cutter body defining a fabric cutter back. The fabric cutter further includes a finger extending rearwardly toward the handle from the outward margin of the fabric cutter body, the finger having a finger back forming a continuous surface with the fabric cutter back. The fabric cutter body, the finger, and a portion of the blade back define a fabric cutter slot having a slot outer side, a slot inner side, and a slot bottom. The slot outer side and the slot inner side are substantially parallel to each other and are separated by a distance of from about 0.100 inches to about 0.150 inches, most preferably about 0.125 inches. An outer ramp extends from the slot outer side to the slot bottom, an inner ramp extends from the slot inner side to a second end of the slot bottom, and there is a cutting edge at the slot bottom.

The finger is displaced laterally outwardly from the knife back and positioned at an angle to the handle of the knife. The finger is preferably displaced outwardly from the knife back so that the slot width is from 0.100 inch to 0.150 inch, most preferably about 0.125 inch. The finger desirably has an angle of at least about 5 degrees, preferably about 13.5 degrees, outwardly from the axis of the handle. The outward displacement of the finger defines the slot as an outwardly protruding structure, rather than a cutout from the interior of the knife blade. The movement of the slot from the interior of the knife blade to a protruding position permits the material being cut to move into the slot more easily. The angular rotation of the finger from the axis of the handle permits the fabric to be cut to be easily inserted into the slot and moved through the cutting edge at the bottom of the slot.

The fabric cutter and remainder of the blade are desirably formed of a single piece of material for robustness. The material is preferably a metal for strength and which can be sharpened in the region of the cutting edge, holds the sharpened edge through multiple uses, and is thereafter easily sharpened. The preferred material of construction of the blade and its integral fabric cutter is stainless steel.

The finger performs the important function of guiding the fabric cutter into the material, or, alternatively stated, guiding the material being cut into the slot. The finger also holds the fabric in the slot, so that the reactive force of the fabric as it is forced into the slot cannot push the knife out of the material. In this use, the finger reaches behind the fabric being cut, and is the element of the structure of the knife that is closest to the trapped person, in the case of the normal use of the knife for rescue. The finger therefore is made smooth along its sides, preferably by chamfering, and at the end inserted behind the fabric.

The finger back and the hook back form a continuous surface termed a "tabletop". The tabletop surface, in cooperation with the position and angular orientation of the finger, guides the hook along the intended path during the cutting operation.

The slot accomplishes the actual cutting of the material fed into the slot, and its structure is a key to the cutting operation. As the material feeds into the slot, it must be prevented from bunching and buckling. The narrow width of the slot accomplishes this stabilization of the fabric. Ramps at the transition between the sides of the slot and the cutting edge aid in the presentation of the material to the cutting edge. The cutting edge is relatively small in length and is positioned at the bottom of the slot, where it cannot ordinarily come into contact with anything other than the fabric being cut. In particular, the cutting edge cannot cut either the trapped person or the rescuer, even under adverse conditions.

As discussed above, the surfaces of the finger and the remainder of the blade, except for the cutting edge at the slot bottom, are desirably rounded. The blade supporting the fabric cutter may optionally be sharpened on the side opposite from the fabric cutter. However, it is preferred that no portion of the blade other than the cutting edge at the bottom of the slot be sharpened or have any rough surface, to avoid tangling in clothing or accidentally cutting the trapped person or the rescuer. In this regard, the term "blade" herein is used to mean the supporting structure of the fabric cutter that is preferably longer than it is wide. The use of the term "blade" in itself does not suggest the presence of a cutting edge other than that at the bottom of the slot.

The blade is joined to the knife in either a fixed or movable manner. In the latter case, the knife is preferably embodied as a folding or pocket knife, with the blade pivotably joined to the handle. Such a knife may also provide other blades, such as a conventional drop point or other cutting blade that the knife user may open for use as necessary. In this case, it is preferred to use a two-blade, folding-knife design wherein one of the blades is a conventional cutting blade and the other blade has the fabric cutter of the invention. Such a knife, when structured to provide a lock-open feature for the blades and to permit one-handed blade operation, is of particular value to rescue personnel because of its various uses and ease of use.

In the parent application Ser. No. 07/929,731, there was described a gut hook knife that is particularly effective in the skinning of animals. It has been found that some, but not all, of the principles underlying the effectiveness of that gut hook knife are applicable in relation to a fabric cutter, and that there are other considerations in the case of the heavy fabric. Animal skin has hair or fur on one side, while the seat belt has nothing analogous. The animal hair or fur tends to clog the cutter slot and cutting edge, but also acts in a springy manner to laterally support the hide being cut within the cutting slot. The absence of the hair or fur permits the seat belt cutting to be accomplished without requiring that the cutting edge of the seat belt cutter engage the hairless side of the piece being cut. However, the absence of hair or fur to position the material being cut requires that care be taken to guide the seat belt to the cutting edge and prevent it from buckling, which would also clog the cutting edge. Guiding and prevention of buckling are accomplished by dimensioning the width of the cutter slot to give lateral support to the fabric as it is moved through the cutting edge, so that it cannot buckle sideways.

The present invention provides an important advance in the art of cutting implements, and specifically knives used by emergency personnel to free trapped persons by cutting a seat belt. The fabric cutter is highly effective in cutting a tensioned seat belt. It also is designed so that preferably there is only a single cutting edge on the blade, at the slot bottom. In this position, the cutting edge cuts fabric pushed into the slot, but it cannot cut the user or the trapped person.

Other features and advantages of the present invention will be apparent from the following more detailed description of the preferred embodiment, taken in conjunction with the accompanying drawings, which illustrate, by way of example, the principles of the invention.

DESCRIPTION OF THE INVENTION

Figure 1:
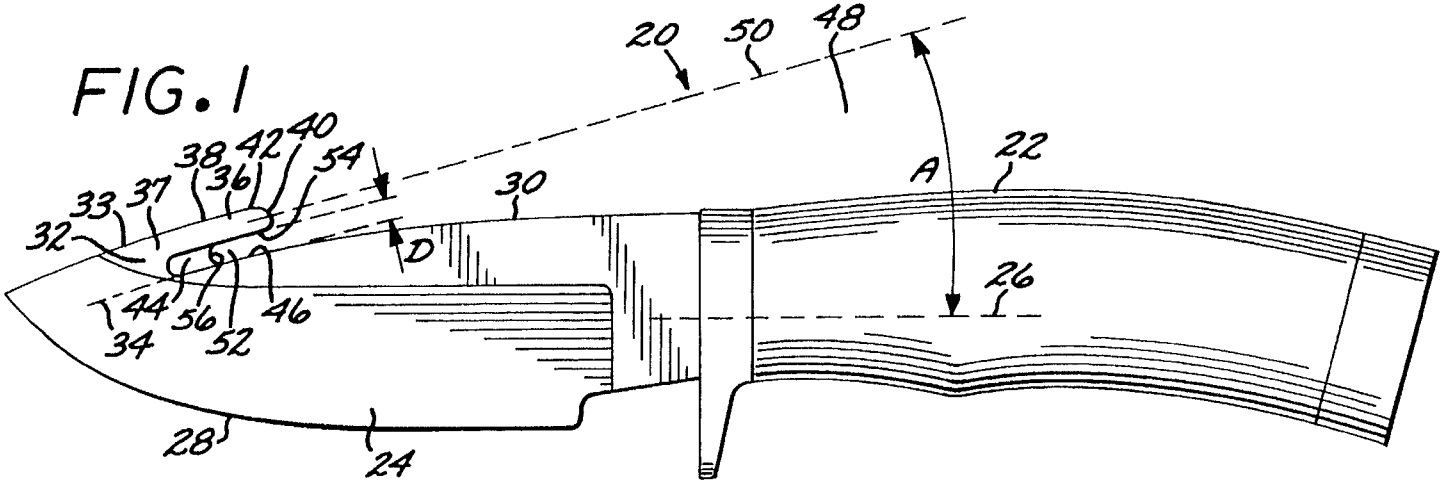
FIG. 1 is an elevational view of a fixed blade knife having a fabric cutter in accordance with the invention.
Figure 2:
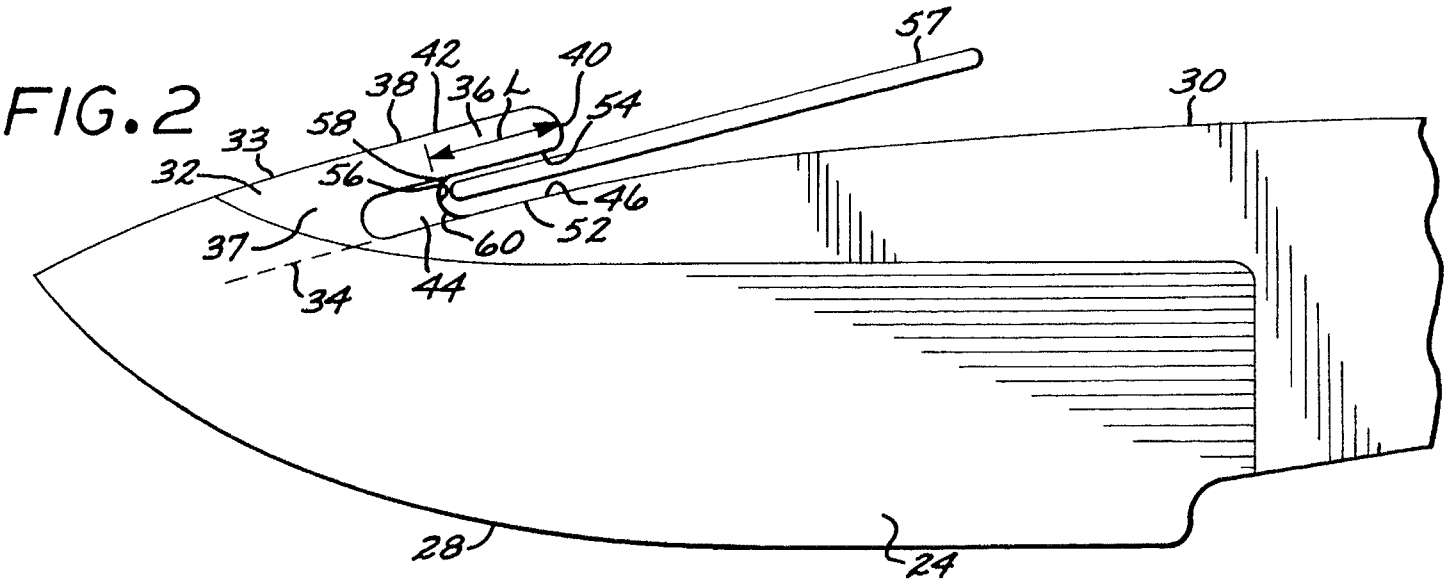
FIG. 2 is an enlarged detail of the fabric cutter of the knife of FIG. 1, as it is used to cut a seat belt.

FIG. 1 depicts a knife 20 utilizing the fabric cutter of the invention, and FIG. 2 shows an enlargement of the region of the fabric cutter as it cuts a seat belt. The knife 20 has a handle 22 and a blade 24 fixed to the handle 22. The embodiment of FIG. 1 a fixed blade knife, and a folding blade knife using the fabric cutter will be discussed subsequently in relation to FIG. 4. For reference purposes, the handle 22 may be described as having a handle axis 26 defining the orientation of the handle 22 at the point where it is joined to the blade 24. The blade 24 of FIG. 1 has a sharpened edge 28 and a back 30 on the opposing side of the blade. Both the handle 22 and the blade 24 may otherwise be curved and provided with other features commonly found in knives and not inconsistent with the fabric cutter structure to be described subsequently. Thus, for example, the blade back 30 and the blade front side 28 may be slightly curved toward each other.

Integrally attached to the blade 24 along its back 30 and remote from the handle 22 is a fabric cutter body 32. The fabric cutter body 32 lies in the plane of the blade 24 and extends laterally outwardly from the blade 24 in a direction generally (although not necessarily exactly) parallel to the blade back 30. The fabric cutter body 32 terminates in a fabric cutter back 33 remote from the main body of the blade 24. The fabric cutter back 33 is a surface that is slightly curved to lie parallel to an extrapolation 34 of the blade back 30, but is otherwise generally flat.

A finger 36 is integral with the fabric cutter body 32 and extends rearwardly from an outer margin 37 of the fabric cutter body 32 toward the handle 22. The fabric cutter body 32, the blade 24, and the finger 36 are conveniently fabricated as a single unit of a metal such as stainless steel, but are here discussed as separate regions of that unit for convenience. Because it is joined to the fabric cutter body 32 at its outward margin, the finger 36 is laterally displaced from the knife back 30. The finger 36 is preferably of generally uniform, though slightly tapered, section. Its sides 38 and tip 40 are chamfered and smoothed, without sharp edges that could inadvertently cut something other than the fabric that is intentionally cut.

The finger 36 is oriented so that its finger back 42 forms a continuous smooth surface with the fabric cutter back 33, sometimes collectively termed herein the "table top". The fabric cutter body 32 and the blade 24 are configured such that the finger 36 is angularly oriented with respect to the handle axis 26 with an offset angle A. The table top acts as a support surface that can be positioned to rest against the body of the trapped person to aid in guiding the knife through the fabric. When used in this way, the table top acts much like the fence of a table saw, to guide the material being cut through the cutting implement, at a fixed spacing. The combination of the table top and the angular orientation A of the finger 36 aid in firmly positioning the knife during the rescue operation. The combination of the lateral displacement of the finger 36 and the offset angle A create a space 48 between an extrapolation 50 of the finger 36 and the handle 22 that provides the room for the user of the knife 20 to grasp the handle 22 and use the knife 20 during the rescue operation.

Figure 3:
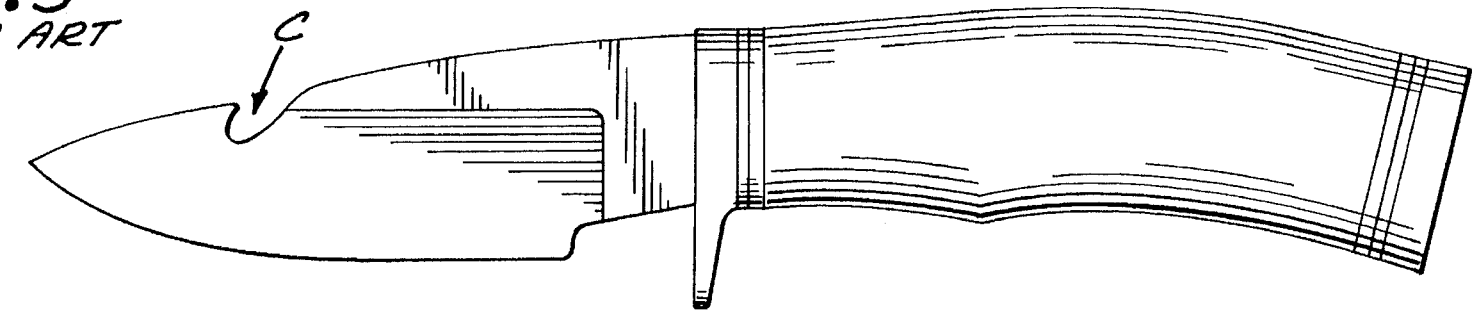
FIG. 3 PRIOR ART
FIG. 3 is an elevational view of a prior fixed blade knife with a conventional gut hook.

The finger 36, a rearwardly facing edge 44 of the fabric cutter body 32, and a portion 46 of the blade back 30 together define a slot 52. Because the fabric cutter body 32 laterally separates the finger 36 from the blade back 30, the slot 52 is raised above the blade back 30. Although the knife of the invention bears some resemblance to conventional gut hooks, this configuration is distinct from that of gut hooks previously known in the art, and illustrated generally in FIG. 3. Here, there is a cutout C in the blade of the knife, extending below the back of the blade. It is difficult if not impossible to cut smoothly through seat belt fabric with such a conventional gut hook.

One side of the slot 52 is formed by a portion 54 of the finger 36 that lies generally parallel to the portion 46 of the blade back 30 that forms the opposing side of the slot 52. The bottom of the slot 52, formed by the rear facing edge 44 of the fabric cutter body 32, is sharpened to form a cutting edge 56. The cutting edge 56 may be rounded, or it may be straight and oriented at an angle of about 90 degrees to the fabric cutter back 33, the finger back 42, and the extrapolation 34 of the blade back 30.

As shown in FIG. 2, fabric such as a seat belt 57 fed into the slot 52 for cutting is raised into the cutting edge 56 by an outer ramp 58 that angles from the portion 54 of the finger 36 to the cutting edge 56. The raising of the piece of fabric as it passes along the outer ramp 58 orients the fabric and places it into lateral tension so that its leading edge is presented squarely to the cutting edge 56. There is also desirably provided an inner ramp 60 that angles from the portion 46 of the blade back 30 that forms the inner side of the slot 52 to the cutting edge 56. The inner ramp 60 aids in guiding thicker pieces of material into the cutting edge 56, but is not needed where thin pieces of material are cut. The outer and inner ramps 58 and 60 are desirably radiused regions with a radius of curvature of about 0.090 inches.

In a preferred version of the knife 20 having the configuration shown in FIG. 1, the finger 36 is substantially parallel to the portion 46 of the blade back 30, and is laterally displaced from the portion 46 by a distance D that is from about 0.100 inch to about 0.150 inches, and is most preferably about 0.125 inches. If the distance D is less than about 0.100 inch, a standard seat belt of thickness 0.055 inches still fits into the slot, but the width of the slot is so small that it cannot be effectively used to cut other fabrics. Also, where the width D of the slot is smaller than about 0.100 inches, it has been found difficult to insert the fabric into the slot when the fabric cutter is used in adverse conditions. If the distance D is more than about 0.150 inch, the seat belt tends to buckle as it moves into the slot and bunches at the bottom of the slot. Further cutting is consequently halted. The preferred distance D is a compromise between ease of insertion of the seat belt into the slot and tolerance of a minor amount of buckling, as shown in FIG. 2. These dimensions are chosen to accomplish the most challenging cutting task for which the present knife was specifically designed, seat belt cutting. However, the knife can also be used to cut thinner, less tough fabrics such as the clothing worn by the trapped person, such as denim or cotton. This cutting may be necessary to reach the seat belt, following an accident where the person's clothing becomes tangled around the seat belt.

The angle A of the finger 36 relative to the handle axis 26 is preferably at least about 5 degrees, and is most preferably about 13.5 degrees. If the angle A is less, the space 48 is insufficient for most users. As the angle A becomes very large, the pulling force exerted on the handle 22 during use of the knife, when resolved into the component parallel to the finger 36, is typically insufficient for cutting a seat belt. Additionally, if the angle A is too large, it may become difficult to use the knife to cut a seat belt in a confined space.

The length L of the finger 36 must be at least about 0.2 inches, and is preferably about 0.3 inches. The finger 36 has several important functions when the knife 20 is used. It guides the knife 20 as it is pulled along the cutting track, and it also holds the knife 20 in the fabric since it extends into the uncut region of the fabric. If the length L is less than the indicated minimum, then the finger 36, and thence the knife 20, tends to pop out of the inserted cutting position when the knife 20 is used. This is an important consideration, since a key advantage of the present knife 20 is its ability to remain automatically in the correct cutting position when in use, so that the user need not concentrate his attention on maintaining the knife 20 within the fabric being cut. Instead, the user can concentrate his attention on guiding the knife along the desired cutting path.

Figure 4:
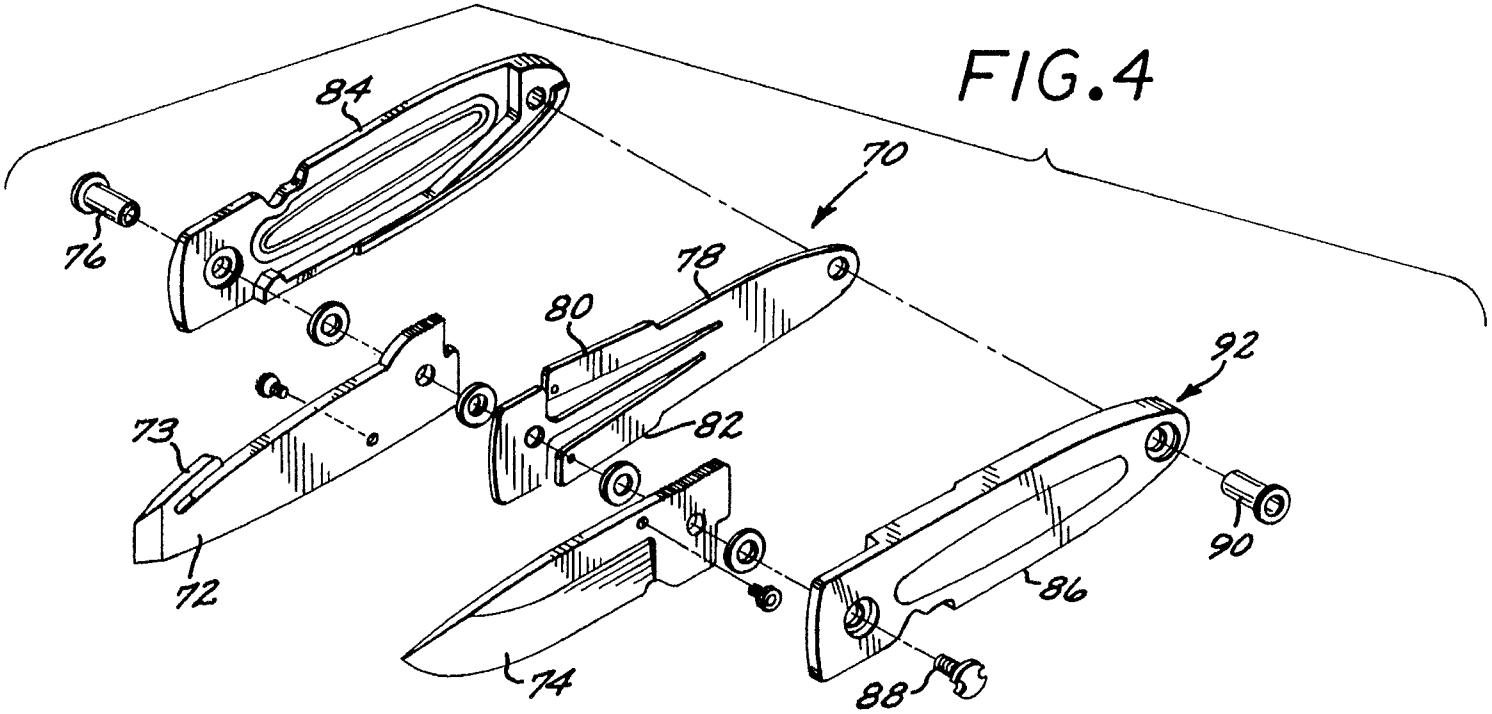
FIG. 4 is an exploded perspective view of a two-bladed folding knife, one of which blades has the fabric cutter of the invention.

FIG. 4 illustrates in exploded perspective view a folding-blade knife 70 having two blades that are movably, here pivotably, joined to a handle. A seat-belt cutter blade 72 includes a fabric cutter 73 like that described previously in relation to a fixed blade knife. The seat-belt cutter blade 72 is sharpened only within its slot and not on either side. A conventional drop point blade 74 is sharpened on one side. FIG. 4 shows both blades 72 and 74 open and extended for ease of illustration, but in normal service at most only one of the blades would be open at any time.

The pivoting/folding mechanism of this knife 70 is described in detail in application Ser. No. 08/138,703, and will be discussed briefly here. The blades 72 and 74 are supported on a single axle 76. A single side lock plate 78 lies between the blades 72 and 74. The side lock plate 78 has fingers 80 and 82 that respectively engage the blades 72 and 74 in their open positions, to lock the blades in the open positions. To unlock the blade, its finger is pressed inwardly. The blade can then be rotated into its closed position.

Side pieces 84 and 86 lie outwardly of the blades 72 and 74, respectively. When the various elements are assembled, fasteners 88 and 90 hold the side pieces 84 and 86, the blades 72 and 74, and the side lock plate 78 into a single unit. The side pieces 84 and 86 form a handle 92 for the knife. The closed blades lie within the handle 92.

The folding knife 70 having the two types of blades is particularly useful for police, emergency medical technicians, and other emergency services personnel. The blades can be folded away for compactness and controllably opened, one at a time, for use. The drop point blade 74 is opened and used for general cutting applications. The fabric cutter blade 72 is opened and used for fabric cutting applications close to a trapped person who might be cut if the drop point blade were used. The knife 70 can be operated completely with one hand, allowing the user to use the other hand for positioning, grasping, or other activity.

Knives having fabric cutters structures according to the preferred embodiment discussed above have been constructed and tested in the cutting of seat belt material and other fabrics. Tensioned seat belts could be readily cut with one hand grasping the knife in a single smooth cutting motion that required 1–2 seconds. The cut was made most easily on a slight diagonal due to the weave of the material. Tensioned thinner fabric could also be cut with ease.

For comparison, attempts were made to cut a seat belt with several types of cutting implements. Conventional scissors could not cut the seat belt. Heavy duty shears could cut the fabric, but required multiple time-consuming cutting attempts and a large amount of space to operate the shears. A conventional sharp drop-point blade knife was able to cut the seat belt fabric in laboratory tests, but in a field situation there would be a high risk of cutting either the trapped person or the rescuer with the sharpened blade. Cutting of the seat belt fabric using both a conventional gut hook of the type shown in FIG. 3 and an improved gut hook of the type described in application Ser. No. 07/929,731 was also attempted. Applicant is not aware of any use of gut hooks for the cutting of seat belts, but made the comparative test because of the superficial slight similarity of structure of the conventional gut hook and the present seat belt cutter. In each case, the fabric of the seat belt folded and bunched together within the interior of the gut hook to prevent smooth cutting.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A knife, comprising:

a handle;

a blade joined to the handle and having a blade back; and a fabric cutter integral with the blade and including a fabric cutter body extending laterally outwardly from the blade back of the blade, an outwardly extending margin of the fabric cutter body defining a fabric cutter back, a finger with no sharp edges, the finger extending rearwardly toward the handle from the outward margin of the fabric cutter body, the finger having a length of about 0.3 inches, the finger having a finger back forming a continuous surface with the fabric cutter back, the fabric cutter back and finger back being oriented at an angle to the handle of about 13.5 degrees, the fabric cutter body, the finger, and a portion of the blade back defining a fabric cutter slot having a slot outer side and separated from the slot outer side by a distance of about 0.125 inches, and a slot bottom, an outer ramp from the slot outer side to the slot bottom, the outer ramp having a radius of about 0.090 inches, an inner ramp from the slot inner side to the slot bottom, the inner ramp having a radius of about 0.090 inches, and a sharpened cutting edge at the slot bottom.

2. The knife of claim 1, wherein the blade is fixedly joined to the handle.

3. The knife of claim 1, wherein the blade is pivotably joined to the handle.

4. A knife, comprising:

a handle;

a blade joined to the handle and having a blade back; and a fabric cutter integral with the blade and including a fabric cutter body extending laterally outwardly from the blade back of the blade, an outwardly extending margin of the fabric cutter body defining a fabric cutter back, a finger extending rearwardly toward the handle from the outward margin of the fabric cutter body, the finger having a finger back forming a continuous surface with the fabric cutter back, the fabric cutter body, the finger, and a portion of the blade back defining a fabric cutter slot having a slot outer side, a slot inner side, and a slot bottom, the slot outer side and the slot inner side being substantially parallel to each other and separated by a distance of from about 0.100 inches to about 0.150 inches, and a cutting edge at the slot bottom.

5. The knife of claim 4, further including an outer ramp from the slot outer side to the slot bottom, and an inner ramp from the slot inner side to the slot bottom.

6. The knife of claim 4, wherein the finger has a length of at least about 0.2 inches.

7. The knife of claim 4, wherein the blade and the integral fabric cutter are made of a single piece of metal.

8. The knife of claim 4, wherein the slot outer side and the slot inner side are separated by a distance of about 0.125 inches.

9. The knife of claim 4, wherein the blade is fixedly joined to the handle.

10. The knife of claim 4, wherein the blade is movably joined to the handle.

11. The knife of claim 10, further including a second blade movably joined to the handle.

12. A knife, comprising:

a handle;

a blade joined to the handle and having a blade back; and fabric cutter means integral with the blade for controllably cutting fabric inserted into the fabric cutter means, comprising:

finger means for guiding the movement of the knife and preventing it from disengaging from the fabric, the finger means including a finger extending parallel to an adjacent portion of the blade back, having a length of at least about 0.2 inches, and being separated from the adjacent portion of the blade back by a distance of from about 0.100 inches to about 0.150 inches finger support means for supporting the finger at a location laterally outwardly displaced from the adjacent portion of the blade back and at an angle to the handle of more than about 5 degrees, the finger, finger support means, and adjacent portion of the blade back together defining a slot, and a cutting edge within the slot.

13. The knife of claim 12, wherein the blade and the integral fabric cutter means are made of a single piece of metal.

14. The knife of claim 12, wherein the fabric cutter means further includes means for guiding the fabric to the cutting edge.

15. The knife of claim 14, wherein means for guiding includes a pair of ramps, one adjacent either end of the cutting edge.

16. The knife of claim 15, wherein each ramp comprises a radiused transition region having a radius of about 0.090 inches.

17. The knife of claim 12, wherein the finger and the adjacent portion of the blade back are separated by a distance of about 0.125 inches.

18. The knife of claim 12, wherein the blade is fixedly joined to the handle.

19. The knife of claim 12, wherein the blade is pivotably joined to the handle.

20. The knife of claim 19, further including a second blade pivotably joined to the handle.

* * * * *